US010357089B2

(12) United States Patent
Aoki

(10) Patent No.: US 10,357,089 B2
(45) Date of Patent: Jul. 23, 2019

(54) CARRYING CASE

(71) Applicant: Kabushiki Kaisha TOPCON, Tokyo (JP)

(72) Inventor: Takeo Aoki, Tokyo (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 514 days.

(21) Appl. No.: 14/984,110

(22) Filed: Dec. 30, 2015

(65) Prior Publication Data

US 2017/0057695 A1 Mar. 2, 2017

(30) Foreign Application Priority Data

Aug. 25, 2015 (JP) ..... 2015-166171

(51) Int. Cl.
*A45C 5/00* (2006.01)
*A45C 13/36* (2006.01)
(Continued)

(52) U.S. Cl.
CPC ..... *A45C 13/26* (2013.01); *A45C 5/03* (2013.01); *A45C 5/00* (2013.01); *A45C 13/00* (2013.01);
(Continued)

(58) Field of Classification Search
CPC ..... A45F 3/04; A45C 7/0072; A45C 13/26
(Continued)

(56) References Cited

U.S. PATENT DOCUMENTS 3,974,898 A 8/1976 Tullis et al.
4,743,038 A * 5/1988 Myers ..... A45C 5/00 190/18 A
(Continued)

FOREIGN PATENT DOCUMENTS

CN 1468566 A 1/2004
DE 41 07 267 A1 9/1992
(Continued)

OTHER PUBLICATIONS

An Office Action issued by the Chinese Patent Office (SIPO) dated Nov. 3, 2017, which corresponds to Chinese patent Application No. 201511000899.8 and is related to U.S. Appl. No. 14/984,110; with English language translation.
(Continued)

*Primary Examiner* — Anthony D Stashick
*Assistant Examiner* — Raven Collins
(74) *Attorney, Agent, or Firm* — Studebaker & Brackett PC

(57) ABSTRACT

A carrying case has a flat top surface and bottom surface aligned in a first direction (Z direction) and includes two top surface rib grooves, extending in a second direction (X direction) perpendicular to the first direction and recessed in the first direction, on the top surface and four interfering projections, projecting in the first direction, on the bottom surface. Both ends of one of the top surface side rib grooves seen from the second direction are inclined toward one side in a third direction (Y direction) perpendicular to the second direction and both ends of the other top surface side rib groove seen from the second direction are inclined toward the other side in the third direction. The respective interfering projections are disposed corresponding to the respective inclining portions such that the interfering projections touch the inclining portions from inside.

8 Claims, 7 Drawing Sheets

(51) Int. Cl.

| | |
|---|---|
| ***A45C 13/26*** | (2006.01) |
| ***A45C 5/03*** | (2006.01) |
| *A45F 3/04* | (2006.01) |
| *A45C 13/00* | (2006.01) |

(52) U.S. Cl.
CPC ..... *A45C 13/36* (2013.01); *A45C 2005/037* (2013.01); *A45F 3/04* (2013.01)

(58) Field of Classification Search
USPC ..... 206/314, 499; 220/608; 190/18 A; 280/652
See application file for complete search history.

(56) References Cited

U.S. PATENT DOCUMENTS

| | | | | |
|---|---|---|---|---|
| 7,036,358 | B2 | 5/2006 | Nisimura | |
| D543,350 | S * | 5/2007 | Sanderson | D3/201 |
| 2001/0027902 | A1 | 10/2001 | Ishiguro | |
| 2003/0094392 | A1 | 5/2003 | Meier et al. | |
| 2004/0007483 | A1 | 1/2004 | Hasebe | |
| 2008/0277221 | A1 * | 11/2008 | Josefson | A45C 5/14 190/18 A |
| 2009/0178946 | A1 | 7/2009 | Patstone et al. | |

FOREIGN PATENT DOCUMENTS

| | | | |
|---|---|---|---|
| DE | 203 08 394 | U1 | 9/2003 |
| DE | 20 2014 008 993 | U1 | 1/2015 |
| EP | 2 805 799 | A2 | 11/2014 |
| GB | 2 266 881 | A | 11/1993 |
| JP | H10-016971 | A | 1/1998 |
| JP | 2001-292820 | A | 10/2001 |
| JP | 2003-90724 | A | 3/2003 |
| JP | 2006-103725 | A | 4/2006 |
| JP | 2008-290728 | A | 12/2008 |
| JP | 2012-056585 | A | 3/2012 |
| WO | 02/11955 | A1 | 2/2002 |

OTHER PUBLICATIONS

The extended European search report issued by the European Patent Office dated Aug. 21, 2017, which corresponds to European Patent Application No. 15201778.6-1653 and is related to U.S. Appl. No. 14/984,110.

An Office Action mailed by the Japanese Patent Office dated Feb. 19, 2019, which corresponds to Japanese Patent Application No. 2015-166171 and is related to U.S. Appl. No. 14/984,110.

* cited by examiner

CARRYING CASE

CROSS-REFERENCE TO RELATED APPLICATION

The present application is based on and claims priority to Japanese patent application No. 2015-166171, filed Aug. 25, 2015, the disclosure of which is hereby incorporated by reference herein in its entirety.

BACKGROUND

Technical Field

The present invention relates to a carrying case.

Description of Related Art

In a survey, it is required to carry a survey instrument such as a total station on a survey site. Therefore, a carrying case capable of accommodating the survey instrument may be used (e.g. refer to JP 2003-090724 A). Such a carrying case, by accommodating the survey instrument therein, allows the survey instrument to be easily carried while protecting the instrument.

SUMMARY

Meanwhile, there are cases where a plurality of survey instruments is used and thus the respective instruments are collected while accommodated in the carrying case upon transportation or storage. Therefore, a structure to allow piling up a plurality of cases is desirable. However, the aforementioned carrying case does not have a structure to allow piling up the plurality of carrying cases. If the piled up cases are misaligned with each other, the case may fall from a high position, which may result in a failure of the accommodated survey instrument which is a precision instrument. Therefore, the carrying case may be improved further from a perspective of preventing misalignment when the plurality of carrying cases are piled up.

The present invention has been devised in consideration of the aforementioned circumstances, and an object thereof is to provide a carrying case where the plurality of carrying cases can be piled up without causing misalignment.

In order to solve the above problem, a carrying case according to an embodiment of the present invention has a flat top surface and a flat bottom surface aligned in a first direction and includes two top surface rib grooves, extending in a second direction perpendicular to the first direction and recessed in the first direction, on the top surface and four interfering projections, projecting in the first direction, on the bottom surface. Both ends of one of the top surface side rib grooves seen from the second direction are inclined toward one side in a third direction perpendicular to the second direction and both ends of the other top surface side rib groove seen from the second direction are inclined toward the other side in the third direction. The respective interfering projections are disposed at positions corresponding to the respective inclining portions such that the respective interfering projections are in contact with the respective inclining portions of the respective top surface rib grooves from the inside thereof.

A carrying case according to an embodiment of the present invention allows the plurality of carrying cases to be piled up without causing misalignment.

DETAILED DESCRIPTION

Figure 1:
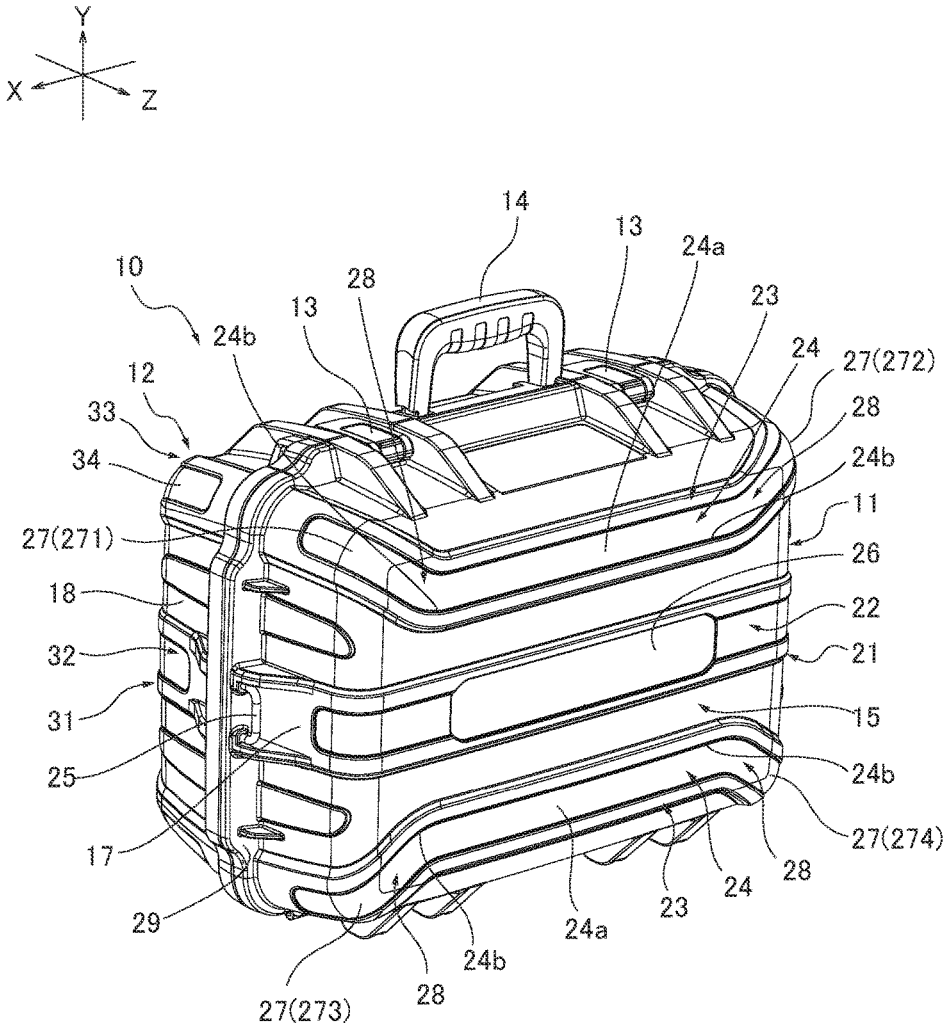
FIG. 1 is an explanatory view seen from a top surface side for illustrating a carrying case of an exemplary embodiment of the present invention.

A schematic configuration of a carrying case 10 as an exemplary embodiment according to the present invention will be described with reference to FIGS. 1 to 7. Note that, in order to explain the action between top surface rib grooves 24 and respective interfering projections 35, FIG. 6 illustrates, when two carrying cases 10 are piled up in the Z direction (first direction), a top surface 15 (first outer shell part 11) of the lower carrying case 10 seen from the Z direction positive side and the respective interfering projections 35, provided to a bottom surface 16 (second outer shell part 12) of the upper carrying case 10, in a two-dot chain line over the top surface 15.

Figure 2:
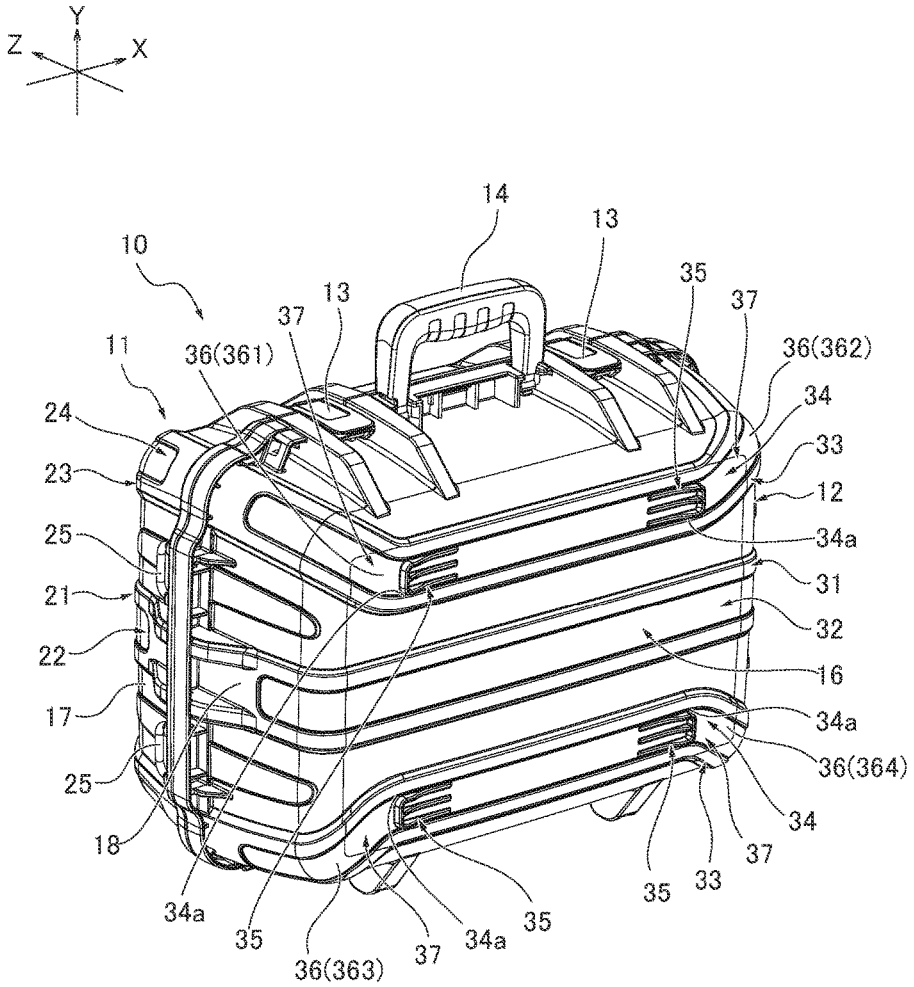
FIG. 2 is an explanatory view seen from a bottom surface side for illustrating the carrying case.

The carrying case 10, by accommodating an article therein, allows the article to be easily carried while protecting the article. In the present embodiment, a survey instrument such as a total station is accommodated in the case. The carrying case 10 is structured by closing a first outer shell part 11 and a second outer shell part 12 to form an accommodating space as illustrated in FIGS. 1 and 2. In the description below, a direction where the first outer shell part 11 and second outer shell part 12 are facing each other when closed is referred to as a Z direction and a side of the first outer shell part 11 is referred to as a Z direction positive side. Also, a direction perpendicular to the Z direction on a plane where the carrying case 10 is placed on is referred to as an X direction (second direction) and an anterior side, when FIG. 1 is seen from the front, is referred to as an X direction positive side. Furthermore, a direction perpendicular to the X direction and Z direction is referred to as a Y direction (third direction) and an upper side when FIGS. 1 and 2 are seen from the front is referred to as a Y direction positive side.

The first outer shell part 11 and second outer shell part 12 each has a bowl shape and is formed by injection molding with a resin material in the present embodiment. The first outer shell part 11 and second outer shell part 12 are connected to each other in a freely openable and closable manner via a hinge provided to an end on a Y direction negative side and are fixed in a closed state by a fastener 13 provided to an end in the Y direction positive side. In the present embodiment, the first outer shell part 11 and second outer shell part 12 have a long parallelepiped shape in the X direction in the closed state and are made portable by a gripper 14 provided to the end in the Y direction positive side. This carrying case 10 can be piled up in the Z direction with the second outer shell part 12 facing downward and the first outer shell part 11 facing upward as will be described later (refer to FIG. 5). Therefore, in the carrying case 10, a flat surface of the first outer shell part 11 in the Z direction forms a top surface 15 (refer to FIG. 1) while a flat surface of the second outer shell part 12 in the Z direction forms a bottom surface 16 (refer to FIG. 2). Each of the top surface 15 and bottom surface 16 is parallel to a plane including the X direction and Y direction and aligned in the Z direction. The top surface 15 and bottom surface 16 each has a square shape seen from the Z direction.

Figure 3:
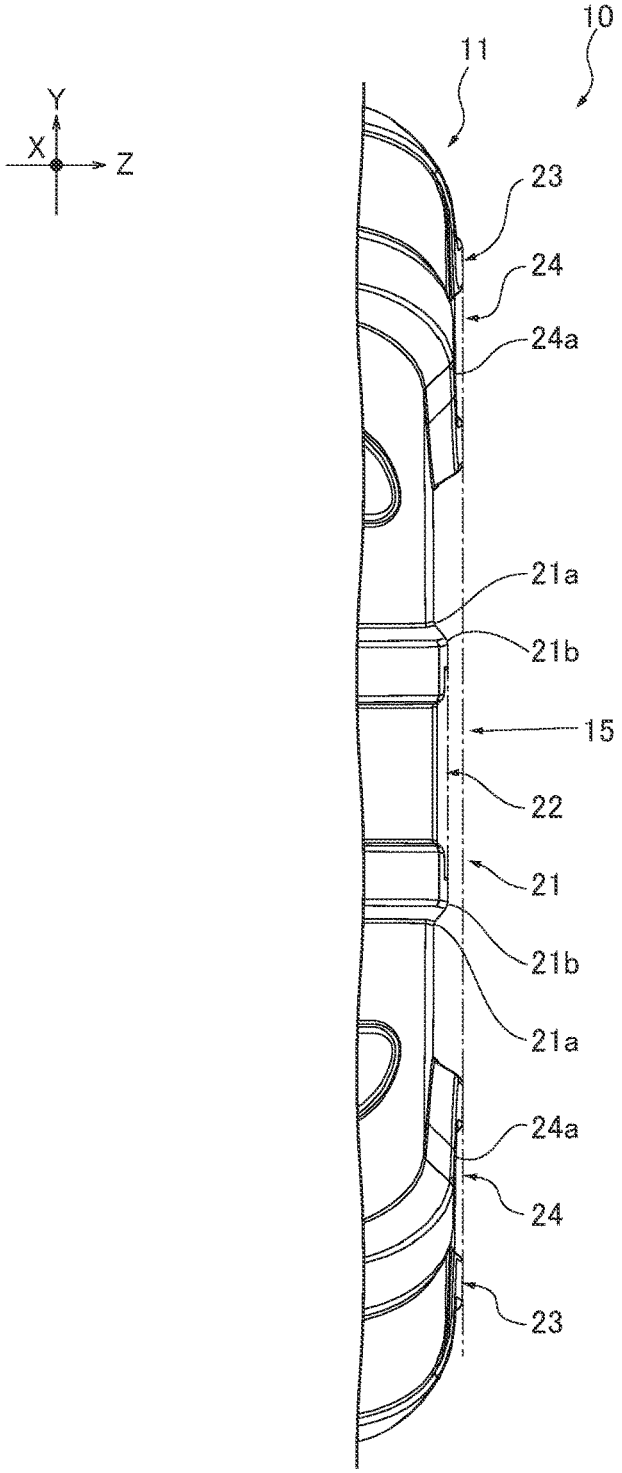
FIG. 3 is an explanatory view (end view) seen from an X direction positive side for illustrating a top surface center rib projection and top surface side rib projections.

As illustrated in FIGS. 1 and 3, the first outer shell part 11 includes a top surface center rib projection 21, a top surface center rib groove 22, a pair of top surface side rib projections 23, a pair of top surface rib grooves 24, and three attaching brackets 25 (refer to FIGS. 1 and 2). The top surface center rib projection 21 is formed on the top surface 15 in a center part seen from the Y direction while projecting in the Z direction positive side and extending in the X direction with a uniform dimension in the Y direction (width dimension) and the Z direction (height dimension) across the entire length. This top surface center rib projection 21 has a square shape (projecting from the top surface 15 while forming a U-shape) seen from a cross-section thereof perpendicular to the extending direction of X direction. Projection end portions 21*b* on a projection end side are formed to have a gentler curve than that formed by base end portions 21*a* rising from the top surface 15 (refer to FIG. 3). In the present embodiment, the base end portions 21*a* form a curve with a diameter of R while the projection end portions 21*b* form a curve with a diameter of 2R. Ends of the top surface center rib projection 21 seen from the X direction respectively extend to X side surfaces 17 positioned in the X direction in the first outer shell part 11.

The top surface center rib projection 21 includes the top surface center rib groove 22. This top surface center rib groove 22 is formed by recessing, in the Z direction negative side, a center part in the top surface center rib projection 21 seen from the Y direction and extending along the top surface center rib projection 21 (X direction). The top surface center rib groove 22 has a uniform dimension in the Y direction (width dimension) and the Z direction (depth dimension) across the entire length. In the present embodiment, the width dimension shall have a size capable of accommodating a protrusion of the backbone in the back of an average person. In the present embodiment, the top surface center rib groove 22 includes a plate 26 for showing a cooperation name, product name, brand name, or the like. This plate 26 does not change the depth dimension of the top surface center rib groove 22.

The pair of top surface side rib projections 23 is formed in positions surrounding the top surface center rib projection 21 in the Y direction, namely, a position in the Y direction positive side and a position in the Y direction negative side from the top surface center rib projection 21, while projecting in the Z direction positive side and extending in the X direction. The top surface side rib projections 23 have a uniform dimension in the Y direction (width dimension) and the Z direction (height dimension) across the entire length and have an exterior shape of a square shape (projecting from the top surface 15 while forming a U-shape) seen from a cross-section thereof perpendicular to the extending direction of X direction. The top surface side rib projections 23 project more in the Z direction than the top surface center rib projection 21 (refer to FIG. 3). Both ends of these top surface side rib projections 23 on the top surface 15 seen from the X direction form a curve toward the closest one of four top surface corners 27 on the top surface 15 (first outer shell part 11) and extend over the top surface corners 27, thereby inclining in the X direction and Y direction.

Each of the top surface side rib projections 23 includes the top surface rib groove 24. Each of the top surface rib grooves 24 is formed by recessing, in the Z direction negative side, a center part in the corresponding top surface side rib projection 23 seen from the Y direction and extending along the top surface side rib projection 23 (basically in the X direction). Each of the top surface rib grooves 24 has a uniform dimension in the Y direction (width dimension) and the Z direction (depth dimension) across the entire length and has a flat bottom wall surface 24*a*, recessed in the Z direction negative side from the top surface side rib projections 23, parallel to a plane including the X direction and Y direction. As a result, as illustrated in FIG. 1, in each of the top surface rib grooves 24, a center part seen from the X direction extends in the X direction and both ends seen from the X direction form a curve along the corresponding top surface side rib projections 23 toward the corresponding top surface corners 27 on the top surface 15 (first outer shell part 11) and extend over the corresponding top surface corners 27. As a result, in each of the top surface rib grooves 24, a length from a top surface curve originating point 24*b* where the curve starts to the corresponding top surface corners 27 forms a top surface inclining portion 28 which inclines in the X direction and Y direction. At least a part of the top surface inclining portion 28 is disposed on the top surface 15. This results in that, in the top surface rib groove 24 in the Y direction positive side, the top surface inclining portion 28 in the X direction positive side extends toward and over the top surface corner 27 (271) in the X direction positive side and Y direction positive side while the top surface inclining portion 28 in the X direction negative side extends toward and over the top surface corner 27 (272) in the X direction negative side and Y direction positive side. Also, in the top surface rib groove 24 in the Y direction negative side, the top surface inclining portion 28 in the X direction positive side extends toward and over the top surface corner 27 (273) in the X direction positive side and Y direction negative side while the top surface inclining portion 28 in the X direction negative side extends toward and over the top surface corner 27 (274) in the X direction negative side and Y direction negative side.

As illustrated in FIGS. 1 and 2, the three attaching brackets 25 are provided to circular rib projections 29 in the first outer shell part 11. Each of the attaching brackets 25 is formed by bending a rod-shaped member made from a metal material into a U-shape and is provided in such a manner as to project from the circular rib projection 29 in the Z direction positive side. One of the attaching brackets 25 is provided to the X side surface 17 in the X direction positive side (refer to FIG. 1) while the other two are provided to the X side surfaces 17 in the X direction negative side while aligned in the Y direction (refer to FIG. 2). A belt member 43, which will be described later (refer to FIG. 7), can be attached to these attaching brackets 25.

As illustrated in FIG. 2, the second outer shell part 12 includes a bottom surface center rib projection 31, a bottom surface center rib groove 32, a pair of bottom surface side rib projections 33, a pair of bottom surface rib grooves 34, and four interfering projections 35. The bottom surface center rib projection 31 is formed on the bottom surface 16 in a center part seen from the Y direction while projecting in the Z direction negative side and extending in the X direction with a uniform dimension in the Y direction (width dimension) and the Z direction (height dimension) across the entire length. Ends of the bottom surface center rib projection 31 seen from the X direction respectively extend to X side surfaces 18 positioned in the X direction in the second outer shell part 12.

The bottom surface center rib projection 31 includes the bottom surface center rib groove 32. This bottom surface center rib groove 32 is formed by recessing, in the Z direction positive side, a center part in the bottom surface center rib projection 31 seen from the Y direction and extending along the bottom surface center rib projection 31 (X direction). The bottom surface center rib groove 32 has a uniform dimension in the Y direction (width dimension) and the Z direction (depth dimension) across the entire length.

The pair of bottom surface side rib projections 33 is formed in positions surrounding the bottom surface center rib projection 31 in the Y direction, namely, a position in the Y direction positive side and a position in the Y direction negative side from the bottom surface center rib projection 31, while projecting in the Z direction negative side and extending in the X direction. The bottom surface side rib projections 33 have a uniform dimension in the Y direction (width dimension) and the Z direction (height dimension) across the entire length and has an exterior shape of a square shape (projecting from the bottom surface 16 while forming a U-shape) seen from a cross-section thereof perpendicular to the extending direction of X direction. Both ends of these bottom surface side rib projections 33 on the bottom surface 16 seen from the X direction form a curve toward the closest one of four bottom surface corners 36 on the bottom surface 16 (second outer shell part 12) and extend over the bottom surface corners 36 while inclining in the X direction and Y direction.

Each of the bottom surface side rib projections 33 includes the bottom surface rib groove 34. Each of the bottom surface rib grooves 34 is formed by recessing, in the Z direction positive side, a center part in the corresponding bottom surface side rib projection 33 seen from the Y direction and extending along the bottom surface side rib projection 33 (basically in the X direction). Each of the bottom surface rib grooves 34 has a uniform dimension in the Y direction (width dimension) and the Z direction (depth dimension) across the entire length. As a result, in each of the bottom surface rib grooves 34, a center part seen from the X direction extends in the X direction and both ends seen from the X direction form a curve along the corresponding bottom surface side rib projection 33 toward the corresponding bottom surface corners 36 on the bottom surface 16 (second outer shell part 12) and extend over the corresponding bottom surface corners 36. As a result, in each of the bottom surface rib grooves 34, a length from a bottom surface curve originating point 34*a* where a curve starts to corresponding bottom surface corners 36 forms a bottom surface inclining portion 37 which inclines in the X direction and Y direction. At least a part of the bottom surface inclining portion 37 is disposed on the bottom surface 16. This results in that, in the bottom surface rib groove 34 in the Y direction positive side, the bottom surface inclining portion 37 in the X direction negative side extends toward and over the bottom surface corner 36 (361) in the X direction negative side and Y direction positive side while the bottom surface inclining portion 37 in the X direction positive side extends toward and over the bottom surface corner 36 (362) in the X direction positive side and Y direction positive side. Also, in the bottom surface rib groove 34 in the Y direction negative side, the bottom surface inclining portion 37 in the X direction negative side extends toward and over the bottom surface corner 36 (363) in the X direction negative side and Y direction negative side while the bottom surface inclining portion 37 in the X direction positive side extends toward and over the bottom surface corner 36 (364) in the X direction positive side and Y direction negative side.

In the present embodiment, seen from the Z direction, the bottom surface center rib projection 31 and bottom surface center rib groove 32 correspond to the top surface center rib projection 21 and top surface center rib groove 22 provided to the first outer shell part 11, respectively. The bottom surface side rib projections 33 and the bottom surface rib grooves 34 corresponds to the top surface side rib projections 23 and top surface rib grooves 24 provided to the first outer shell part 11, respectively. Therefore, the carrying case 10 gives substantially the same impression seen from the top surface 15 side and the bottom surface 16 side.

Four interfering projections 35 are provided to the bottom surface rib grooves 34. The interfering projections 35 are provided in such a manner as to protrude, from the respective bottom surface rib grooves 34 in the Z direction negative side, higher than the respective bottom surface side rib projections 33. Each of the interfering projections 35 has a same shape apart from differences in a provided position and direction and thus a structure thereof will be described with reference to FIG. 4 illustrating the enlarged interfering projection 35 in the upper right in FIG. 2.

Figure 4:
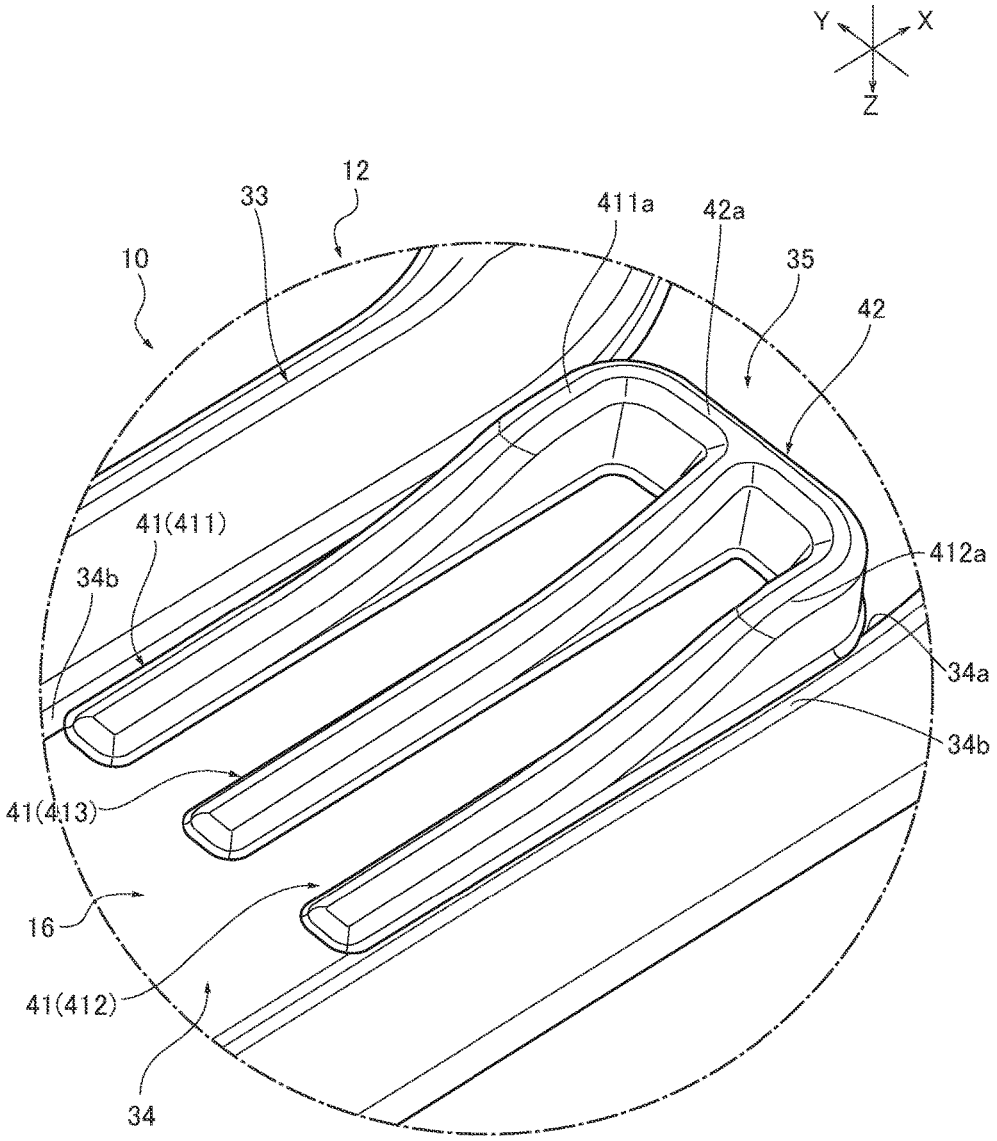
FIG. 4 is an enlarged explanatory view illustrating an interfering projection provided to the bottom surface.

In the present embodiment, as illustrated in FIG. 4, the interfering projection 35 is structured by connecting three X projecting strips 41 projecting in the Z direction negative side and extending in the X direction with a Y projecting strip 42 projecting in the Z direction negative side and extending in the Y direction. The Y projecting strip 42 has a thin and long plate shape bridging inside the bottom surface rib groove 34 in the Y direction, projects in the Z direction negative side higher than the bottom surface side rib projections 33, and has a flat projecting end surface 42*a* parallel to a plane including the X direction and Y direction. In the present embodiment, the Y projecting strip 42 of the interfering projection 35 is disposed at the bottom surface curve originating point 34*a*, where the bottom surface inclining portion 37 starts, in the bottom surface rib groove 34 while the respective X projecting strips 41 is disposed along the bottom surface rib groove 34 extending in the X direction.

The three X projecting strips 41 has a thin and long plate shape extending in the X direction and is formed in such a manner as to project in the Z direction negative side higher than the bottom surface side rib projections 33 and be aligned in the Y direction. Out of the X projecting strips 41, when illustrated separately, the one in the end in the Y direction positive side is referred to as the X projecting strip 411, the one in the end in the Y direction negative side is referred to as the X projecting strip 412, and the one in the middle in the Y direction is referred to as the X projecting strip 413. The two X projecting strips 411 and 412 on the both ends are provided close to side wall surfaces 34*b* of the bottom surface rib groove 34 and have projecting end surfaces 411*a* and 412*a* communicating with the projecting end surface 42*a* of the Y projecting strip 42 These projecting end surfaces 411*a* and 412*a* form a flat surface, having a height same as that of the projecting end surface 42*a* of the Y projecting strip 42, parallel to and same as the projecting end surface 42*a* and are disposed close to the Y projecting strip 42 (projecting end surface 42*a*). As a result, the respective X projecting strips 41 (interfering projection 35) are provided such that the interfering projections 35 are accommodated within the corresponding bottom surface rib groove 34 in the Y direction. Each of the X projecting strips 41 projects less in the Z direction negative side as the strip extends toward the inner side of the bottom surface 16

(second outer shell part 12) in the X direction. Also, in the X projecting strips 411 and 412, end portions of the projecting end surfaces 411*a* and 412*a* are the originating point of reduced projections while, in the X projecting strip 413, an end portion of the projecting end surface 42*a* of the Y projecting strip 42 is the originating point of reduced projection.

Figure 5:
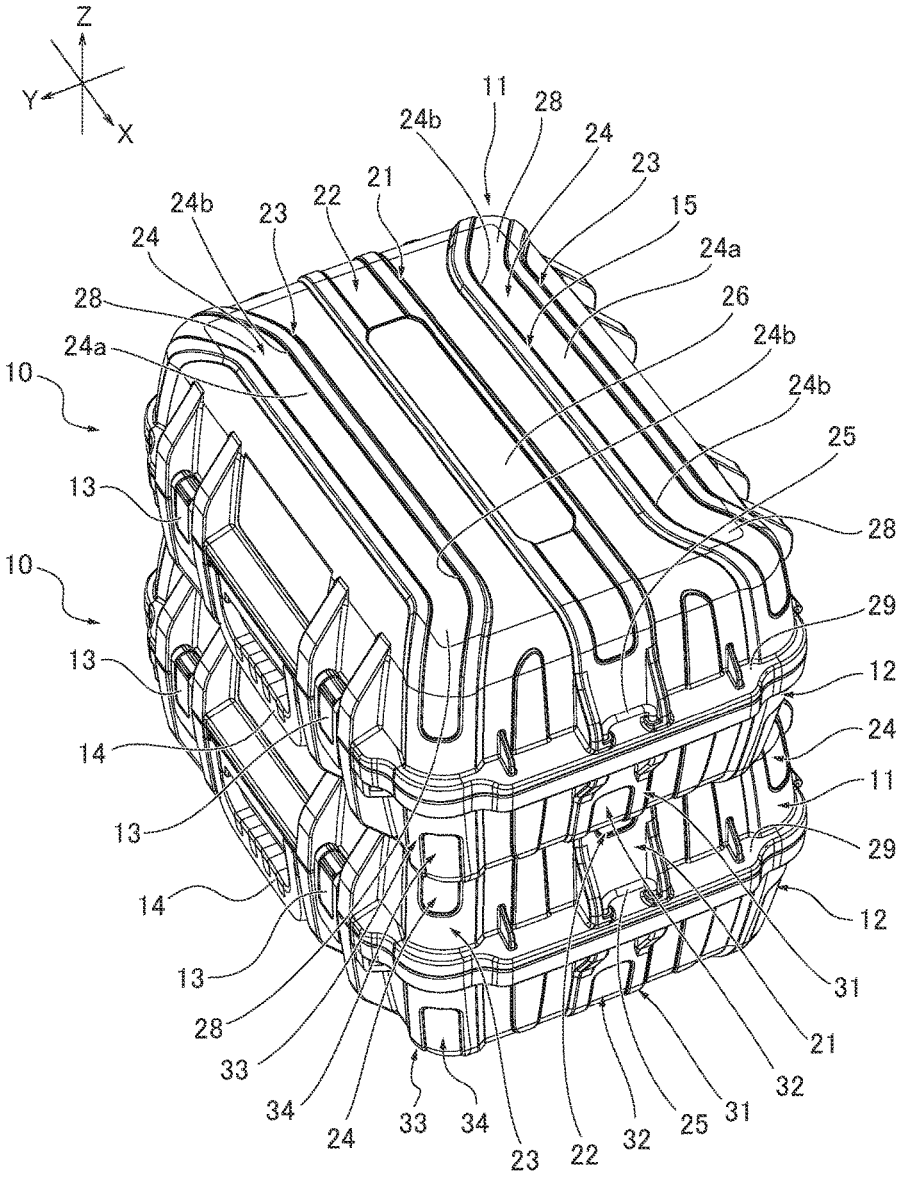
FIG. 5 is an explanatory view illustrating the piled up carrying cases.
Figure 6:
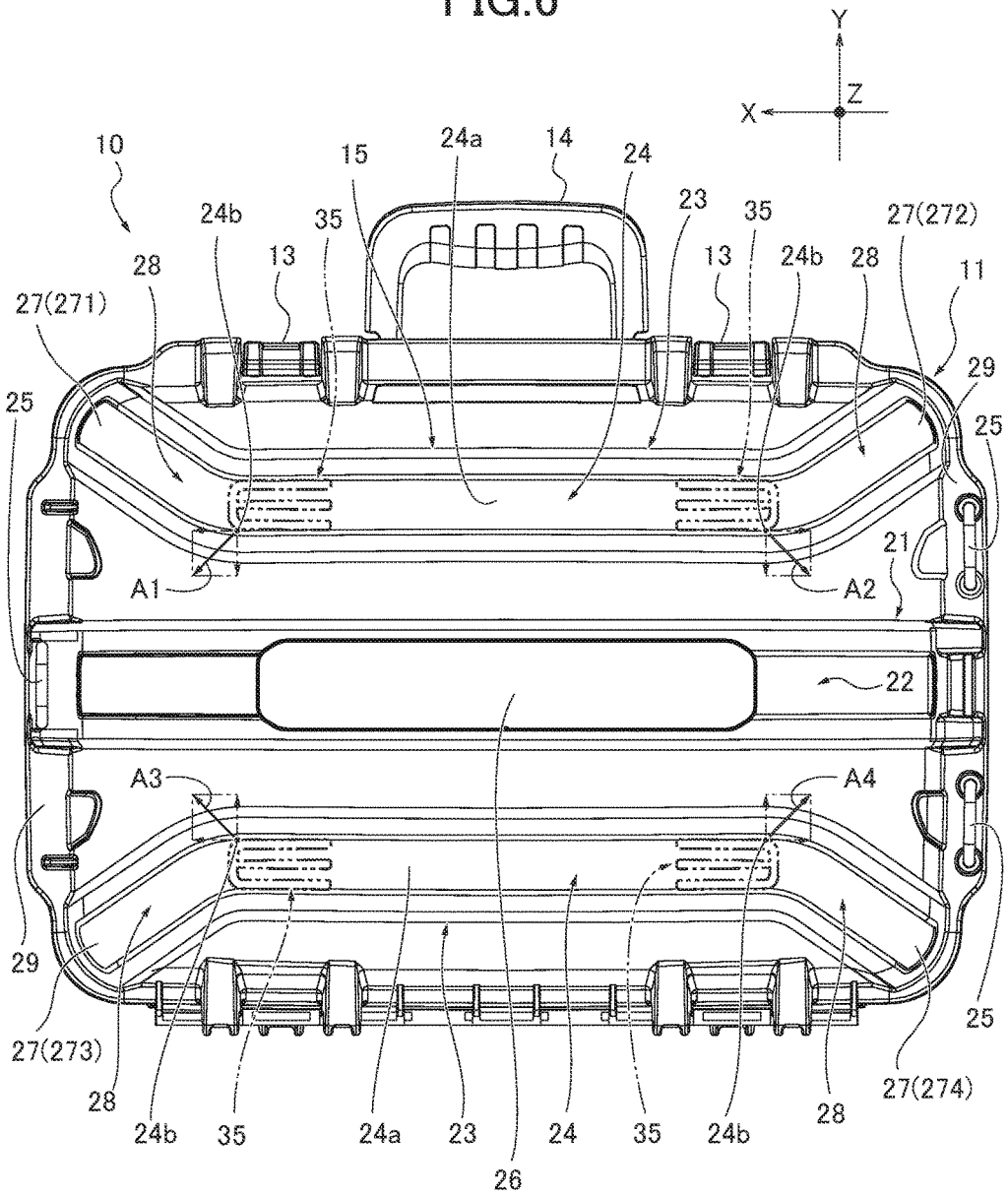
FIG. 6 is an explanatory view illustrating top surface side rib grooves and the respective interfering projections preventing misalignment of the cases.

As illustrated in FIG. 5, such a structure allows for preventing misalignment of the cases 10 when two carrying cases 10 are piled up in the Z direction with the top surface 15 of one case placed on the bottom surface 16 of the other case. This is due to the following reason. The bottom surface rib grooves 34 of the second outer shell part 12 and the top surface rib grooves 24 of the first outer shell part 11 correspond to each other seen from the Z direction. Therefore, as illustrated in FIG. 6, the respective interfering projections 35, provided to the respective bottom surface curve originating points 34*a* (refer to FIG. 2) of the respective bottom surface rib grooves 34 in the upper carrying case 10, separately correspond to the respective top surface curve originating points 24*b* of the respective top surface rib grooves 24 in the lower carrying case 10. Moreover, since the respective interfering projections 35 are provided in such a manner as to project more in the Z direction negative side than the bottom surface side rib projections 33 such that the interfering projections 35 are accommodated within the bottom surface rib grooves 34 in the Y direction, the interfering projections 35 are accommodated in the corresponding top surface rib grooves 24 while being in contact with the top surface curve originating points 24*b*. As a result, since the projecting end surface 42*a* of the Y projecting strip 42 and the projecting end surfaces 411*a* and 412*a* (refer to FIG. 4) of the X projecting strips 411 and 412 are flat and parallel to a plane including the X direction and Y direction, the respective interfering projections 35 contact the bottom wall surface 24*a* of the top surface rib grooves 24, the surface of which is also flat and parallel to a plane including the X direction and Y direction.

Therefore, the upper carrying case 10, where the respective interfering projections 35 are in contact, is limited to move relative to the lower carrying case 10 as follows. The interfering projection 35 in the X direction positive side and the Y direction positive side is in contact with the top surface curve originating point 24*b*, in the X direction positive side, of the (one) top surface rib groove 24 in the Y direction positive side, thereby limiting movement in the X direction positive side and Y direction negative side (refer to an arrow A1 in FIG. 6). The interfering projection 35 in the X direction negative side and the Y direction positive side is in contact with the top surface curve originating point 24*b*, in the X direction negative side, of the (one) top surface rib groove 24 in the Y direction positive side, thereby limiting movement in the X direction negative side and Y direction negative side (refer to an arrow A2 in FIG. 6). The interfering projection 35 in the X direction positive side and the Y direction negative side is in contact with the top surface curve originating point 24*b*, in the X direction positive side, of the (other) top surface rib groove 24 in the Y direction negative side, thereby limiting movement in the X direction positive side and Y direction positive side (refer to an arrow A3 in FIG. 6). The interfering projection 35 in the X direction negative side and the Y direction negative side is in contact with the top surface curve originating point 24*b*, in the X direction negative side, of the (other) top surface rib groove 24 in the Y direction negative side, thereby limiting movement in the X direction negative side and Y direction positive side (refer to an arrow A4 in FIG. 6). In this manner, the four interfering projections 35 in the carrying case 10 placed in the upper position are accommodated in the two top surface rib grooves 24 of the carrying case 10 placed in the lower position, thereby preventing relative movement in the X direction and Y direction, namely, preventing misalignment between the cases. Even when two or more carrying cases 10 are piled up, a similar effect can be obtained between the cases adjacent to each other in the Z direction, thereby preventing misalignment between the cases. Therefore, in the carrying case 10, the Z direction functions as the first direction, the X direction as the second direction, and the Y direction as the third direction.

Figure 7:
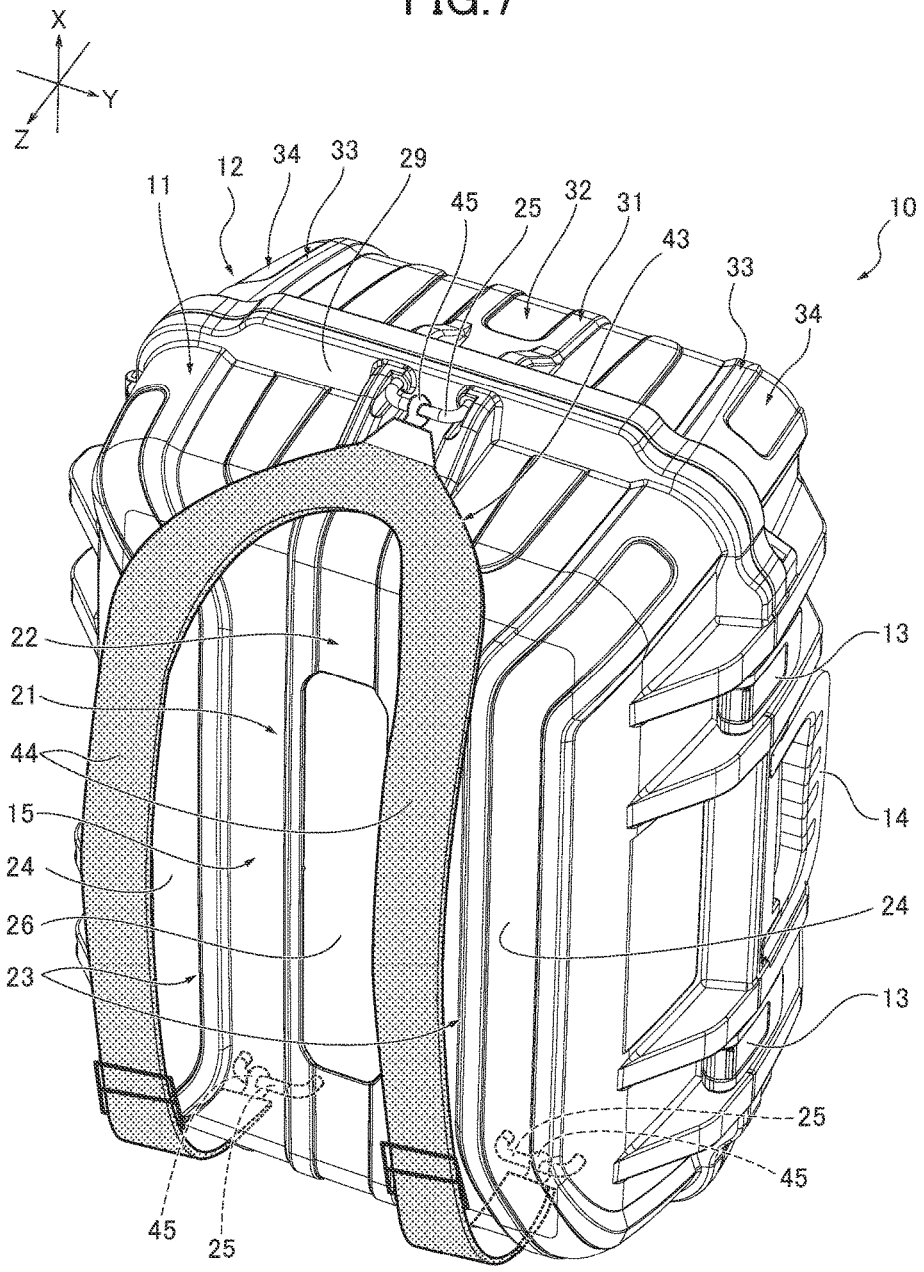
FIG. 7 is an explanatory view illustrating the carrying case attached with a belt member.

Also in the carrying case 10, as illustrated in FIG. 7, the belt member 43 can be attached thereto. This belt member 43 is attached to allow a person to carry the carrying case 10 on his/her back. In the present embodiment, the belt member 43 includes a belt part 44 and three hooking members 45. The belt part 44 has a belt shape extending in parallel to the X direction while aligned in the Y direction, where ends in the X direction positive side are integrated into one, where the single hooking member 45 is provided to. Also, in the belt part 44, each of the ends in the X direction negative side aligned in the Y direction includes a single hooking member 45. Each of the hooking members 45 is capable of being attached to and being removed from each of the attaching brackets 25 provided to the first outer shell part 11 of the carrying case 10. Therefore, the belt member 43 allows a person to carry the carrying case 10 on his/her back with the hooking member 45 in the X direction positive side attached to the attaching brackets 25 in the X direction positive side in the first outer shell part 11 and the two hooking members 45 in the X direction negative side separately attached to the two attaching brackets 25 in the X direction negative side in the first outer shell part 11. This allows for the carrying case 10 to be further easily carried. Note that in the carrying case 10, attaching an impact absorber on the top surface 15 using the attaching bracket 25 can reduce burden of carrying the case.

In the carrying case 10 as an embodiment of the present invention, when piling up two cases in the Z direction with the bottom surface 16 of one case placed on the top surface 15 of the another case, two interfering projections 35 are in contact with the top surface inclining portions 28 of one of the top surface rib grooves 24, both ends of which are inclined to the Y direction positive side while the other two interfering projections 35 are in contact with the top surface inclining portions 28 of the another top surface rib groove 24, both ends of which are inclined to the Y direction negative side. Therefore, with the carrying case 10, when the carrying cases 10 are piled up, relative movement on a plane including the X direction and Y direction can be prevented, thereby preventing misalignment.

Also, in the carrying case 10, when the cases 10 are piled up in the Z direction, causing contact between the respective interfering projections 35 provided to the bottom surface 16 of the upper case and the respective top surface rib grooves 24 (respective top surface inclining portions 28 thereof) provided to the top surface 15 of the lower case allows for preventing misalignment. Therefore, in the carrying case 10, it is only required to provide the respective top surface rib grooves 24 on the top surface 15. In this manner, different from a case where recessed parts only for receiving the respective interfering projections 35 are formed, the parts that are to be in contact with the respective interfering projections 35 can be integrated in the entire design of the case, thereby giving more freedom to designing while enhancing the designability. Also, in the carrying case 10, since the respective top surface rib grooves 24 provided to the top surface 15 (first outer shell part 11) are used, the parts that are to be in contact with the respective interfering projections 35 can be formed while strength of the top surface 15 (first outer shell part 11) is enhanced.

Also, in the carrying case 10, when the cases are piled up in the Z direction, since four interfering projections 35 of the upper case and the respective top surface inclining portions 28 of two top surface rib grooves 24 of the lower case are in contact with each other, relative movement on a plane including the X direction and Y direction is prevented and thus relative movement toward one direction can be limited by two interfering projections 35. Therefore, in the carrying case 10, misalignment can be prevented with more reliability.

On the square-shaped top surface 15 (first outer shell part 11) of the carrying case 10, the both ends of the top surface rib groove 24 in the Y direction positive side seen from the X direction are inclined toward the top surface corners 27 in the Y direction positive side while the both ends of the top surface rib groove 24 in the Y direction negative side seen from the X direction are inclined toward the top surface corners 27 in the Y direction negative side. Therefore, in the carrying case 10, two top surface rib grooves 24 extending in the X direction can be inclined toward the Y direction positive side and negative side in a smooth manner while providing the respective top surface inclining portions 28 to be in contact with the respective interfering projections 35. Moreover, in the carrying case 10, a shape of the top surface rib grooves 24 on the top surface 15 can be linearly symmetrical with lines extending in the X direction and Y direction, thereby further enhancing the design. Furthermore, in the carrying case 10, the top surface rib grooves 24 also enhance the strength of the respective top surface corners 27.

In the carrying case 10, two bottom surface rib grooves 34, having the same shape as those of the top surface rib grooves 24, are provided to the bottom surface 16 and the respective interfering projections 35 are provided to the respective bottom surface rib grooves 34. Therefore, in the carrying case 10, since structures of the top surface 15 and bottom surface 16 can be substantially the same, the design can be further enhanced while allowing the respective interfering projections 35 to correspond to the respective top surface inclining portions 28 of the top surface rib grooves 24.

In the carrying case 10, the respective interfering projections 35 have dimensions accommodatable in the top surface rib grooves 24 seen from the Y direction. Therefore, in the carrying case 10, the respective interfering projections 35 and the respective top surface rib grooves 24 can be in contact at both ends thereof seen from the Y direction, thereby distributing the force acting on the respective interfering projections 35 and the respective top surface rib grooves 24, thereby preventing movement in the Y direction with more reliability when the cases are piled up. Furthermore, in the carrying case 10, the respective interfering projections 35 can be in contact with the corresponding top surface rib grooves 24 (bottom wall surface 24*a* thereof) with the dimension in the Y direction, thereby distributing the force acting on the respective interfering projections 35 and the respective top surface rib grooves 24 (bottom wall surface 24*a*), thereby suppressing abrasion thereof.

In the carrying case 10, the respective interfering projections 35 are formed by a combination of a plurality of long and thin projecting strips (three X projecting strips 41 and the Y projecting strip 42 in the embodiment). Therefore, in the carrying case 10, even when the respective interfering projections 35 are abrased, creation of a hole in the respective interfering projections 35, namely the second outer shell part 12, can be prevented while allowing the respective interfering projections 35 to have dimensions accommodatable in the top surface rib grooves 24 seen from the Y direction. This is due to the following reason. In order to allow the respective interfering projections (35) to have dimensions accommodatable in the top surface rib grooves 24 seen from the Y direction, it is assumed that the projection has a cuboid shape of such dimensions. In such a case, since the second outer shell part 12 is formed by mold injection, the respective interfering projections (35) become hollow projections with a cuboid shape. This results in that parts forming the respective interfering projections (35) are thin and thus abrasion can lead to a hole thereat. Contrary to this, in the respective interfering projections 35, since the combination of the plurality of long and thin projecting strips (41 and 42) results in dimensions accommodatable in the top surface rib grooves 24 seen from the Y direction, the respective interfering projections can be filled with a material (resin), thereby preventing a hole to be created even with abrasion.

In the carrying case 10, the projecting end surfaces (in the embodiment, the projecting end surfaces 42*a*, 411*a*, and 412*a*) of the respective projecting strips (41 and 42) are in contact with the bottom wall surface 24*a* of the top surface rib groove 24. Therefore, in the carrying case 10, an area where the respective interfering projections 35 are in contact with the top surface rib grooves 24 (bottom wall surface 24*a*), thereby distributing the force acting thereon and suppressing abrasion thereof.

In the carrying case 10, each of the interfering projections 35 is provided in the bottom surface rib groove 34 by disposing the Y projecting strip 42 at the bottom surface curve originating point 34*a*, where the bottom surface inclining portion 37 starts, and disposing each of the X projecting strips 41 along the bottom surface rib groove 34 extending in the X direction. Therefore, in the carrying case 10, the respective interfering projections 35 (Y projecting strips 42 thereof) can be in contact with the respective top surface curve originating points 24*b* of the respective top surface rib grooves 24, thereby limiting movement not only in the Y direction but also in the X direction. Also, in the carrying case 10, since the respective interfering projections 35 are disposed at parts extending in the X direction in the bottom surface rib grooves 34, even when those parts of the respective interfering projections 35 are displaced in the X direction due to a manufacturing error or the like, the respective interfering projections 35 can be accommodated within the corresponding top surface rib grooves 24 when the cases are piled up in the Z direction, thereby preventing misalignment.

In the carrying case 10, the top surface rib grooves 24 are formed by recessing, in the Z direction negative side, the center part, seen from the Y direction, in two top surface side rib projections 23 extending in the X direction. This allows for, in the carrying case 10, integrating the top surface rib grooves 24 in the entire design of the case while further enhancing the strength of the top surface 15 (first outer shell part 11). This allows for, in the carrying case 10, giving more freedom to designing while enhancing the design in addition to preventing misalignment when the cases are piled up.

In the carrying case 10, the bottom surface rib grooves 34 are formed by recessing, in the Z direction positive side, the center part, seen from the Y direction, in two bottom surface side rib projections 33 extending in the X direction. The respective interfering projections 35 are provided to the bottom surface rib grooves 34. This allows for, in the carrying case 10, integrating the bottom surface rib grooves 34 and the respective interfering projections 35 in the entire design of the case while further enhancing the strength of the bottom surface 16 (second outer shell part 12). Especially in the carrying case 10, when seen from the Z direction, the bottom surface side rib projections 33 and the bottom surface rib grooves 34 correspond to the top surface side rib projections 23 and top surface rib grooves 24, respectively. This allows the top surface 15 (first outer shell part 11) and bottom surface 16 (second outer shell part 12) to give substantially the same impression. This allows for, in the carrying case 10, giving more freedom to designing while further enhancing the design in addition to preventing misalignment when the cases are piled up.

On the top surface 15 of the carrying case 10, the top surface center rib projection 21, extending in the X direction and projecting in the Z direction, is provided between the top surface side rib projections 23 seen from the Y direction. The top surface center rib projection 21 projects less in the Z direction than the top surface side rib projections 23. Therefore, in the carrying case 10 with the X direction directed in the vertical direction, the center part in relation to both sides on the top surface 15 seen from the horizontal direction (Y direction) can be recessed, thereby the shape of the top surface 15 can be matched with that of the backbone. Therefore, when a person carries the carrying case 10 on his/her back using the belt member 43 attached to the respective attaching brackets 25 with the X direction directed in the vertical direction, a burden caused by carrying a heavy load with the top surface 15 touching the back can be mitigated, thereby making it easy to carry the case on the back. The above also applies to a case where the aforementioned impact absorber is attached.

In the carrying case 10, the top surface center rib groove 22 is formed by recessing, in the Z direction negative side, the center part, seen from the Y direction, in the top surface center rib projection 21. Therefore, in the carrying case 10, the top surface center rib projection 21 extending in the X direction can have the same structure as those of the top surface side rib projections 23, also extending in the X direction, provided with the top surface rib grooves 24. This allows for, in the carrying case 10, further enhancing the strength of the top surface 15 (first outer shell part 11) while enhancing the design.

On the top surface 15 of the carrying case 10, the top surface center rib projection 21, extending in the X direction and projecting in the Z direction, is provided between the top surface side rib projections 23 seen from the Y direction. The top surface center rib groove 22 is formed by recessing, in the Z direction positive side, the center part of the top surface center rib projection 21 seen from the Y direction. Therefore, when a person carries the carrying case 10 on his/her back with the top surface 15 touching the back using the belt member 43 attached to the respective attaching brackets 25 with the X direction directed in the vertical direction, the backbone can be accommodated in the top surface center rib groove 22 while preventing the backbone from touching the top surface 15 (top surface center rib groove 22 thereof). Therefore, when a person carries the carrying case 10 on his/her back using the belt member 43 attached to the respective attaching brackets 25 with the X direction directed in the vertical direction, a burden caused by the top surface 15 touching the back can be mitigated, thereby making it easier to carry the case on the back. The above also applies to a case where the aforementioned impact absorber is attached.

In the carrying case 10, since the bottom surface center rib groove 32 is formed in the bottom surface center rib projection 31, the bottom surface center rib projection 31 extending in the X direction can have the same structure as those of the bottom surface side rib projections 33, also extending in the X direction, provided with the bottom surface rib grooves 34. Especially in the carrying case 10, seen from the Z direction, the bottom surface center rib projection 31 and bottom surface center rib groove 32 correspond to the top surface center rib projection 21 and top surface center rib groove 22, respectively. Also, the bottom surface side rib projections 33 and the bottom surface rib grooves 34 correspond to the top surface side rib projections 23 and top surface rib grooves 24, respectively. This allows the top surface 15 (first outer shell part 11) and bottom surface 16 (second outer shell part 12) to give substantially the same impression. This allows for, in the carrying case 10, giving more freedom to designing while further enhancing the design in addition to preventing misalignment when the cases are piled up.

In the carrying case 10, the projection end portions 21*b* on the projection end side are formed to have a gentler curve than that formed by the base end portions 21*a* in the top surface center rib projection 21. Therefore, when a person carries the carrying case 10 on his/her back with the top surface 15 touching the back using the belt member 43 attached to the respective attaching brackets 25 with the X direction directed in the vertical direction, a burden caused by the projection end portions 21*b* of the top surface center rib projection 21 touching the back can be mitigated, thereby making it easy to carry the case on the back. The above also applies to a case where the aforementioned impact absorber is attached.

Therefore, the carrying case 10 as an embodiment of the present invention allows the plurality of carrying cases to be piled up without causing misalignment.

Note that the carrying case 10 has been described as an embodiment of the present invention, a carrying case according to the present invention is not limited thereto. It is only required that a carrying case, where a flat top surface and a flat bottom surface are aligned in a first direction, includes two top surface rib grooves, extending in a second direction perpendicular to the first direction and recessed in the first direction, on the top surface, and further includes four interfering projections, projecting in the first direction, on the bottom surface, where: both ends of one of the top surface side rib grooves seen from the second direction are inclined toward one side in a third direction perpendicular to the second direction; both ends of the other top surface side rib groove seen from the second direction are inclined toward the other side in the third direction; and the respective interfering projections are disposed at positions corresponding to the respective inclining portions such that the respective interfering projections are in contact with the respective inclining portions of the respective top surface rib grooves from the inside thereof, or that a carrying case, where a flat top surface and a flat bottom surface are aligned in a first direction, includes a top surface rib groove, extending in a second direction perpendicular to the first direction and recessed in the first direction, on the top surface and further includes two interfering projections, projecting in the first direction, on the bottom surface, where: the top surface rib groove has an inclining portion inclined toward one side in a third direction perpendicular to the second direction and an inclining portion inclined toward the other side in the third direction; one of the interfering projections limits movement toward one side in the second direction and one side in the third direction by touching any one of the respective inclining portions; and the other interfering projection limits movement toward the other side in the second direction and the other side in the third direction by touching any one of other inclining portions.

Moreover, in the aforementioned embodiment, the both ends of the respective top surface rib grooves 24 seen from the X direction are inclined from the top surface curve originating point 24*b*. However, it is only required to include the top surface inclining portion 28 extending in the X direction and Y direction and thus the top surface rib groove 24 is not limited to the aforementioned embodiment and may be bended or in another manner. Furthermore, in the aforementioned embodiment, the both ends of the top surface rib groove 24 in the Y direction positive side are inclined toward the Y direction positive side and the both ends of the top surface rib grooves 24 in the Y direction negative side are inclined toward the Y direction negative side. However, it is only required that the top surface rib grooves 24 includes the top surface inclining portion 28 extending in the X direction and Y direction and thus the top surface rib groove 24 is not limited to the aforementioned embodiment and may, for example, include one end inclined toward the Y direction positive side and the other end inclined toward the Y direction negative side or in another manner. The number of the top surface rib groove 24 may be one.

Furthermore, in the aforementioned embodiment, the respective interfering projections 35 are provided in the bottom surface rib groove 34 by disposing the Y projecting strip 42 at the bottom surface curve originating point 34*a*, where the bottom surface inclining portion 37 starts, and disposing the respective X projecting strips 41 along the bottom surface rib groove 34 extending in the X direction. However, the respective interfering projections 35 are only required to be provided to a corresponding position to allow contact with the corresponding top surface inclining portion 28 from the inside of the respective top surface rib grooves 24. The interfering projection 35 is not limited to the structure of the aforementioned embodiment and may be provided to the bottom surface inclining portion 37 or have another structure.

In the above embodiment, the respective interfering projections 35 are provided such that the interfering projections 35 are accommodated within the bottom surface rib grooves 34 in the Y direction. However, it is only required that at least one of the interfering projections 35 limits movement in one side of the X direction and one side in the Y direction by touching the top surface inclining portion 28 (including the top surface curve originating point 24*b*) from inside and that at least another interfering projection 35 limits movement in the other side of the X direction and the other side in the Y direction by touching the top surface inclining portion 28 (including the top surface curve originating point 24*b*) from inside. Thus, the interfering projection 35 is not limited to the structure of the aforementioned embodiment.

Although the carrying case according to the embodiment of the present invention has been described, a specific configuration is not limited to the embodiment and thus modification of or addition to a design is allowed as long as it does not depart from the principals of the invention.

What is claimed is:

1. A carrying case comprising:

a flat top surface;

a flat bottom surface, the flat top surface and the flat bottom surface being aligned in a first direction;

two top surface rib grooves extending in a second direction perpendicular to the first direction and recessed in the first direction, on the top surface; and four interfering projections projecting in the first direction, on the bottom surface, wherein both ends of one of the top surface side rib grooves seen from the second direction are inclined toward one side in a third direction perpendicular to the second direction, both ends of the other top surface side rib groove seen from the second direction are inclined toward the other side in the third direction, the respective interfering projections are disposed at positions corresponding to respective inclining portions such that the respective interfering projections are in contact with the respective inclining portions of the respective top surface rib grooves from the inside thereof, the respective interfering projections have dimensions accommodatable in the top surface rib grooves in the third direction, the respective interfering projections are formed by a combination of a plurality of long and thin projecting strips, and the respective interfering projections contact a bottom wall surface of the corresponding top surface rib groove on a projecting end surface of the respective projecting strips projecting in the first direction.

2. The carrying case according to claim 1, wherein the top surface has a square shape seen from the first direction, and the both ends of the top surface side rib grooves seen from the second direction are inclined toward respective corners on the top surface.

3. The carrying case according to claim 2, wherein the bottom surface has a square shape seen from the first direction, the bottom surface includes two bottom surface rib grooves having a shape same as those of the top surface rib grooves seen from the first direction, and the respective interfering projections are provided in the respective bottom surface rib grooves.

4. The carrying case according to claim 1, wherein the top surface includes two rib projections projecting in the first direction and extending in the second direction with both ends thereof seen from the second direction are inclined toward the third direction, and the top surface rib grooves are formed by recessing a center part of the rib projections.

5. The carrying case according to claim 4, wherein the respective rib projections are side rib projections, the top surface includes, between the side rib projections seen from the third direction, a center rib projection projecting in the first direction and extending in the second direction, and the center rib projection projects less in the first direction than the side rib projections.

6. The carrying case according to claim 5, wherein the center rib projection includes a center rib groove recessed from a center thereof and extending in the second direction.

7. The carrying case according to claim 5, wherein the center rib projection has an exterior shape of a square shape seen from a cross-section thereof perpendicular to an extending direction, and projection end portions on a projection end side forms a gentler curve than a curve formed by base end portions rising from the top surface.

8. A carrying case comprising:

a flat top surface;

a flat bottom surface, the flat top surface and the flat bottom surface being aligned in a first direction;

a top surface rib groove extending in a second direction perpendicular to the first direction and recessed in the first direction, on the top surface; and two interfering projections projecting in the first direction, on the bottom surface, wherein the top surface rib groove has an inclining portion inclined toward one side in a third direction perpendicular to the second direction and an inclining portion inclined toward the other side in the third direction, one of the interfering projections limits movement toward one side in the second direction and one side in the third direction by touching any one of the respective inclining portions, the other interfering projection limits movement toward the other side in the second direction and the other side in the third direction by touching any one of the other inclining portions, the respective interfering projections have dimensions accommodatable in the top surface rib grooves in the third direction, the respective interfering projections are formed by a combination of a plurality of long and thin projecting strips, and the respective interfering projections contact a bottom wall surface of the corresponding top surface rib groove on a projecting end surface of the respective projecting strips projecting in the first direction.

* * * * *